US006048170A

United States Patent [19]

Dodd

[11] Patent Number: 6,048,170

[45] Date of Patent: Apr. 11, 2000

[54] TURBINE SHROUD RING

[75] Inventor: Alec G Dodd, Derby, United Kingdom

[73] Assignee: Rolls-Royce plc, London, United Kingdom

[21] Appl. No.: 09/210,851

[22] Filed: Dec. 15, 1998

[30] Foreign Application Priority Data

Dec. 19, 1997 [GB] United Kingdom ..... 9726710

[51] Int. Cl.[7] ..... F01D 25/26

[52] U.S. Cl. ..... 415/135; 415/139; 415/173.3; 415/178

[58] Field of Search ..... 415/135, 136, 415/138, 173.1, 173.2, 173.3, 175, 176, 178

[56] References Cited

FOREIGN PATENT DOCUMENTS 1574981 9/1980 United Kingdom .
2121884 1/1984 United Kingdom .
2223811 4/1990 United Kingdom .
2254378 10/1992 United Kingdom .

*Primary Examiner*—Edward K. Look
*Assistant Examiner*—James M. McAleenan
*Attorney, Agent, or Firm*—W. Warren Taltavull; Farkas & Manelli PLLC

[57] ABSTRACT

A variable diameter shroud ring (21) for the turbine of a gas turbine engine (10) comprises a support structure (25) which carries an annular array of circumferentially spaced apart ceramic segments (26). The radially outer surfaces of the segments (26) are overlaid by a plurality of circumferentially extending metallic sheets (38). The sheets (38) serve to inhibit gas leakage through gaps between the segments (26) as the diameter of the shroud ring (21) is varied.

7 Claims, 2 Drawing Sheets

TURBINE SHROUD RING

This invention relates to a turbine shroud ring and in particular to a turbine shroud ring of variable diameter.

Axial flow turbines conventionally comprise axially alternate annular arrays of radially extending stator aerofoil vanes and rotor aerofoil blades. The radially outer extents of the rotor aerofoil blades are surrounded by a shroud ring so that a small radial gap is defined between them. That radial gap is arranged to be as small as possible so as to minimize gas leakage therethrough.

Under steady state conditions, the gap remains substantially constant. However under transient conditions, there can be a variation in the radial gaps magnitude due to thermal growth and/or to the contraction of various mechanical components present.

An active control system for the shroud ring as known within the industry will provide compensation for the variation in the gap magnitude. Essentially, the shroud ring is shrunk or expanded in accordance with operating conditions to maintain the gap at the desired magnitude. GB2042646-B describes a mechanism for achieving this end.

A major difficulty associated with systems that depend upon variation in diameter of a shroud ring is that of inhibiting leakage through the ring itself. In order to facilitate shroud ring diameter variation, joints are usually provided in the ring. However it is these joints that can give rise to the leakage. Indeed the joints can be even more problematical if the shroud ring, as a result of high ambient temperatures, is at least partially constructed from ceramic materials.

It is an object of the present invention to provide a variable diameter turbine shroud ring which has improved resistance to leakage therethrough.

According to the present invention, a variable diameter shroud ring for a turbine comprises an annular array of elements capable of circumferential movement relative to each which cooperate to define a radially inner aerofoil blade confronting surface on said ring, a plurality of circumferentially extending elastic sheet members overlying both each other and the radially outer extents of said annular array of elements, each of said sheet members being of lesser circumferential extent than that of said shroud ring, and support means for supporting said elements and said sheet members, actuation means being provided to vary the diameter of said shroud ring.

Preferably said support means comprises an annular support member carrying a pair of split rings, each of which split rings is configured to support an axial extent of said annular array of elements and elastic sheet members.

Said actuation means to vary the diameter of said shroud ring may be thermally actuated.

Said elements may be ceramic.

Said elastic sheet members may be metallic.

Said elements may be coated with an abradable material on their radially inner surfaces.

Each of said elements may be so configured that a portion thereof is in partially overlapping and sliding relationship with said elements adjacent thereto.

The present invention will now be described, by way of example, with reference to the accompanying drawings in which.

Figure 1:
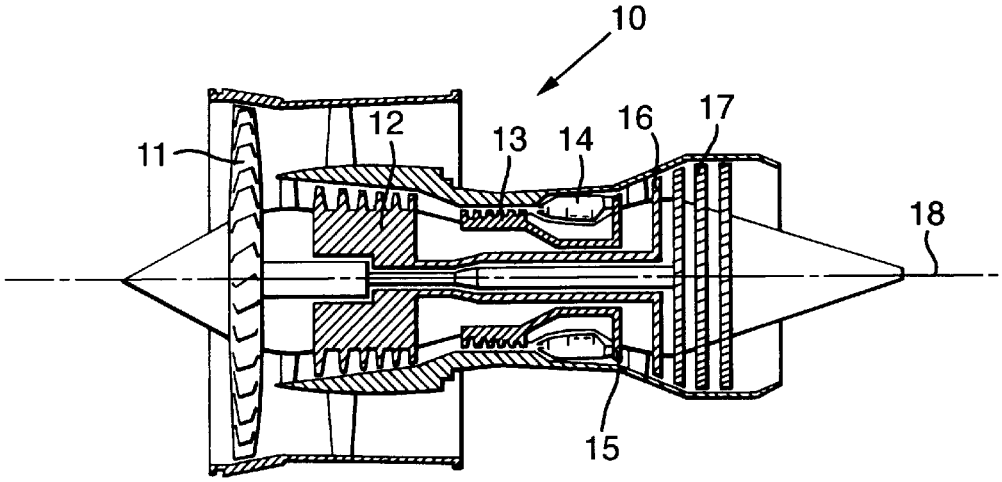
FIG. 1 is a schematic side view of a gas turbine engine having a shroud ring in accordance with the present invention.

With reference to FIG. 1, a ducted fan gas turbine engine generally indicated at 10 is of generally conventional configuration. It comprises, in axial flow series, a propulsive fan 11, intermediate and high pressure compressors 12 and 13 respectively, combustion equipment 14 and high, intermediate and low pressure turbines 15, 16 and 17 respectively. The high, intermediate and low pressure turbines 15, 16 and 17 are respectively drivingly connected to the high and intermediate pressure compressors 13 and 12 and the propulsive fan 11 by concentric shafts which extend along the longitudinal axis 18 of the engine 10.

The engine 10 functions in the conventional manner whereby air compressed by the fan 11 is divided into two flows: the first and major part by-passes the engine to provide propulsive thrust and the second enters the intermediate pressure compressor 12. The intermediate pressure compressor 12 compresses the air further before it flows into the high pressure compressor 13 where still further compression takes place. The compressed air is the directed into the combustion equipment 14 where it is mixed with fuel and the mixture is combusted. The resultant combustion products then expand through, and thereby drive, the high, intermediate and low pressure turbines 15, 16 and 17. They are finally exhausted from the downstream end of the engine 10 to provide additional propulsive thrust.

Figure 2:
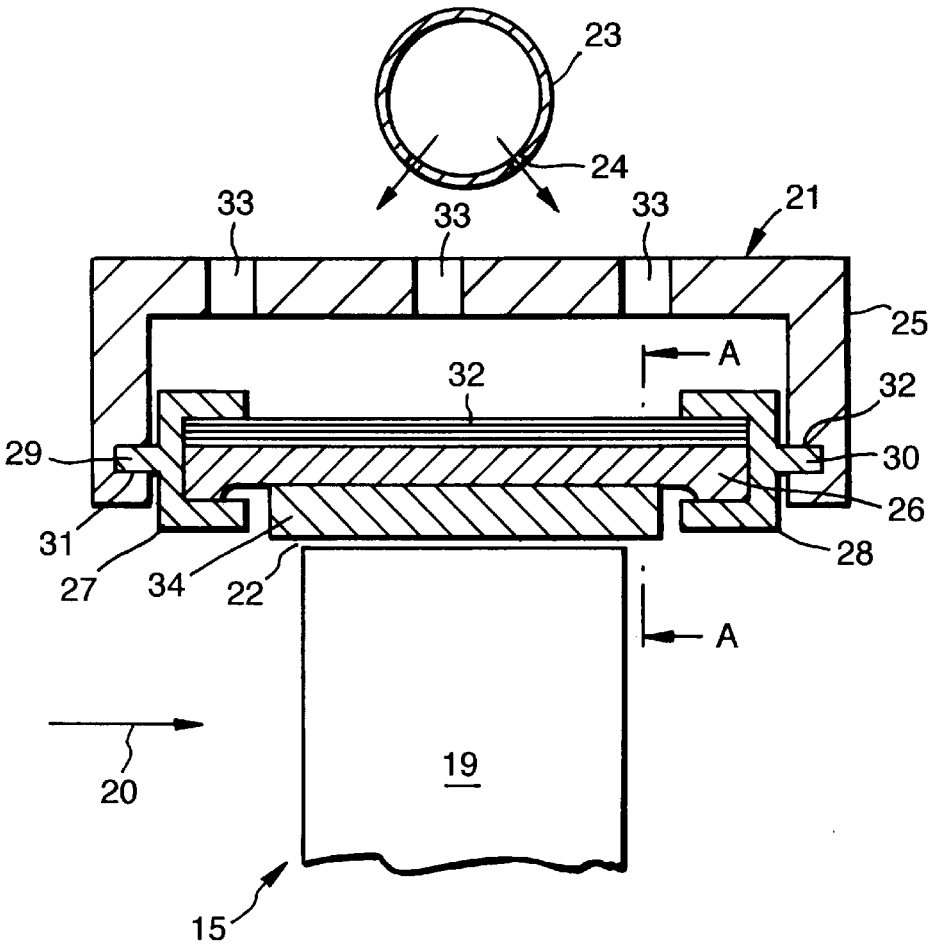
FIG. 2 is a view of the cross-section of a shroud ring in accordance with the present invention.

The high pressure turbine 15 includes an annular array of radially extending rotor aerofoil blades 19, the radially outer part of one of which can be seen if reference is now made to FIG. 2. Hot turbine gases flow over the aerofoil blades 19 in the direction generally indicated by the arrow 20. A shroud ring 21 in accordance with the present invention is positioned radially outwardly of the aerofoil blades 19. It serves to define the radially outer extent of a short length of the gas passage 36 through the high pressure turbine 15.

In the interests of overall turbine efficiency, the radial gap 22 between the outer tips of the aerofoil blades 19 and the shroud ring 21 is arranged to be as small as possible. However, this can give rise to difficulties during normal engine operation. As the engine 10 increases and decreases in speed, temperature changes take place within the high pressure turbine 15. Since the various parts of the high pressure turbine 15 are of differing mass and vary in temperature, they tend to expand and contract at different rates. This, in turn, results in variation of the tip gap 22 varying. In the extreme, this can result either in contact between the shroud ring 21 and the aerofoil blades 19 or the gap 22 becoming so large that turbine efficiency is adversely affected in a significant manner.

This is a well-known effect and there are several well known ways of coping with it. One way is to exert control over the shroud ring 21 so that its diameter varies in such a manner that the gap 22 remains substantially constant. A convenient way of achieving this is to cool the shroud ring 21 with a flow of pressurised air derived from the intermediate pressure compressor 12. The cooling air flow is modulated in such a manner that the shroud ring 21 thermally expands and contracts in an appropriate manner. In the present embodiment of the present invention, that cooling air flow is derived from an annular manifold 23 that is located radially outwardly of the shroud ring 21. The cooling air manifold 23 is provided with a plurality of apertures 24 through which cooling air is directed on to the radially outer surface of the shroud ring 21. The manner in which the airflow through the manifold 23 is modulated is not critical and may be by one of several appropriate techniques known in the art.

The turbine gases flowing over the radially inner surface of the shroud ring 21 are at extremely high temperatures. Consequently, at least that portion of the shroud ring 21 must be constructed from a material which is capable of withstanding those temperatures whilst maintaining its structural integrity. Ceramic materials, such as those based on silicon carbide fibres enclosed in a silicon carbide matrix are particularly well suited to this sort of application. Accordingly, the radially inner part of the shroud ring 21 is at least partially formed from such a ceramic material.

Figure 3:
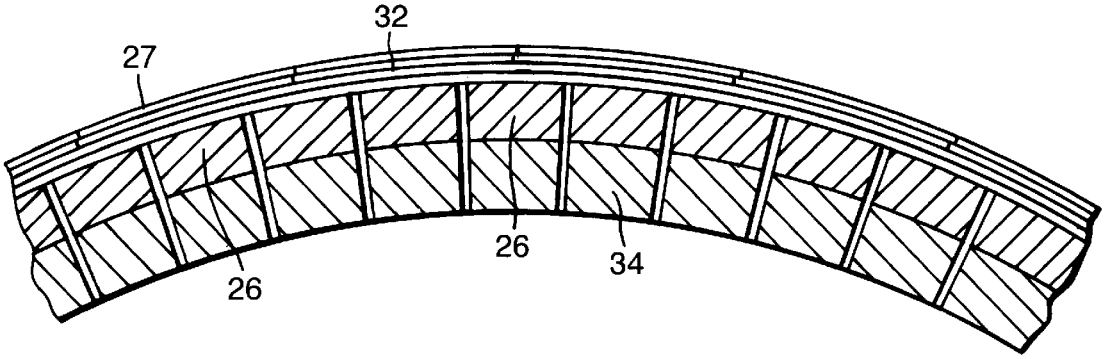
FIG. 3 is a view on section line A—A of FIG. 2.

More specifically, and with additional reference to FIG. 3, the shroud ring 21 is made up of an inverted U-shaped cross-section annular metallic support structure 25 which carries an annular array of circumferentially spaced apart ceramic segments 26. The segments are supported from the support structure 25 at their upstream and downstream ends by metallic split rings 27 and 28 respectively. Each of the rings 27 and 28 is provided with an axially extending flange 29 and 30 respectively. The flanges 29 and 30 locate in correspondingly shaped annular slots 31 and 32 respectively provided in confronting surfaces of the free ends of the support structure 25. It will be seen therefore that as the support structure 25 moves radially inwards and outwards as it thermally expands and contracts, the ceramic segments 26 will move correspondingly.

Since the ceramic shroud segments 26 are circumferentially spaced apart from each other and are thereby capable of circumferential movement relative to each other, they are not placed under stress by the radial movement of the support member 25. However, the gaps between adjacent segments 26 provide a potential leakage path into or out of the turbine gas passage 36.

Figure 4:
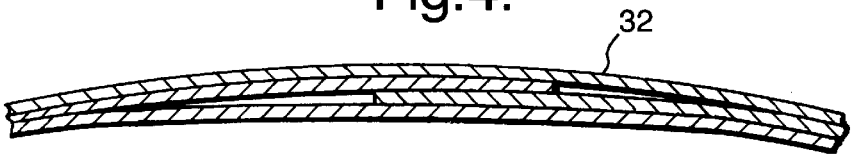
FIG. 4 is a view on an enlarged scale of a portion of the view shown in FIG. 3.

In order to inhibit or prevent such leakage, the radially outer surfaces of the ceramic segments 26 are overlaid by several sheet metal strips 38. Each sheet metal strip 38 extends axially between, and is retained by, the split rings 27 and 28. Each strip 38 also extends circumferentially around the ceramic segments 26, although none of the strips 38 individually extends around the full circumference of the shroud ring 21. Typically each strip 38 extends around approximately a quarter to a half of the full circumference of the shroud ring 21. Additionally, the strips 38 overlie each other at their joints as can be seen most clearly in FIG. 4. A sufficient number of strips 38 is provided to ensure that each ceramic segment 26 is overlaid by at least two of the strips 38.

Apertures 33 are provided in the support member 25 to ensure that the gas pressure radially outwardly of the segments 26 is the same as that in the region where the manifold 23 is located. Since, during engine operation, this pressure is greater than that of the turbine gases radially inwardly of the segments, a radially inward force is exerted upon the strips 38. This is sufficient to ensure that the strips 38 engage both the segments 26 and each other in sealing relationship, thereby inhibiting or preventing gas leakage through the gaps between them.

The strips 38 are sufficiently thin and elastic to ensure that as the shroud ring 21 expands and contracts radially, they deform elastically and slide relative to the segments 26 and to each other so as to conform to the new shroud ring 26 diameter. In doing so, they continue to perform their sealing role.

In order to extend the life of the shroud segments 26, their radially inner surfaces are coated with a conventional abradable material 34.

Figure 5:
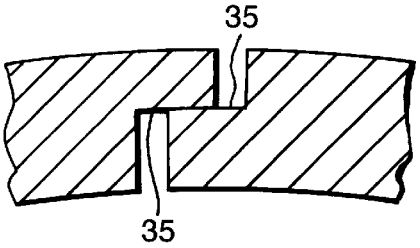
FIG. 5 is a view showing part of a shroud ring that is an alternative embodiment of the present invention.

It is not essential that the segments 26 are circumferentially spaced apart from each other. It is only necessary that they should be configured to permit relative circumferential movement between each other to allow the support member 25 to expand and contract. Thus, for example, the segments 26 could be configured in the manner shown in FIG. 5 in which each segment 26 has a step 35 on each of its circumferential extents which slidingly engages corresponding steps on its adjacent segments 26. Such an arrangement could be advantageous in ensuring that gas leakage between the segments 26 is prevented or reduced to acceptably low levels.

I claim:

1. A variable diameter shroud ring for a turbine comprising an annular array of elements capable of circumferential movement relative to each which cooperate to define a radially inner aerofoil blade confronting surface on said ring, a plurality of circumferentially extending elastic sheet members overlying both each other and the radially outer extents of said annular array of elements, each of said sheet members being of lesser circumferential extent than that of said shroud ring, and support means for supporting said elements and said sheet members, actuation means being provided to vary the diameter of said shroud ring.

2. A shroud ring as claimed in claim 1 wherein said support means comprises an annular support member carrying a pair of split rings, each of which split rings is configured to support an axial extent of said annular array of elements and elastic sheet members.

3. A shroud ring as claimed in claim 1 in which said actuation means to vary the diameter of said shroud ring is thermally actuated.

4. A shroud ring as claimed in claim 1 wherein said elements are ceramic.

5. A shroud ring as claimed in claim 1 wherein said elastic sheet members are metallic.

6. A shroud ring as claimed in claim 1 wherein said elements are coated with an abradable material on their radially inner surfaces.

7. A shroud ring as claimed in claim 1 wherein each of said elements is so configured that a portion thereof is in partially overlapping and sliding relationship with said elements adjacent thereto.

* * * * *